US006228546B1

(12) United States Patent
Kashizaki et al.

(10) Patent No.: US 6,228,546 B1
(45) Date of Patent: May 8, 2001

(54) POLYMER, ELECTROPHOTOGRAPHIC PHOTOSENSITIVE MEMBER CONTAINING THE POLYMER, PROCESS CARTRIDGE AND ELECTROPHOTOGRAPHIC APPARATUS HAVING THE ELECTROPHOTOGRAPHIC PHOTOSENSITIVE MEMBER

(75) Inventors: Yoshio Kashizaki, Yokohama; Akihiro Senoo, Tokyo; Kunihiko Sekido, Susono, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/193,862

(22) Filed: Nov. 18, 1998

(30) Foreign Application Priority Data

Nov. 19, 1997 (JP) ..... 9-318116

(51) Int. Cl.[7] ..... G03G 5/047; G03G 21/18

(52) U.S. Cl. ..... 430/58.25; 430/56; 430/62; 399/111; 399/159

(58) Field of Search ..... 430/58.25, 59.1, 430/59.6, 56, 62; 528/219; 399/159, 111, 116

(56) References Cited

U.S. PATENT DOCUMENTS 4,061,617 * 12/1977 Hay ..... 528/219
5,449,580 * 9/1995 Nakamori et al. ..... 430/58.25

FOREIGN PATENT DOCUMENTS 63-050851 * 3/1988 (JP) ..... 430/59.1
314253 12/1989 (JP) .
123370 5/1990 (JP) .
203352 8/1990 (JP) .
216662 9/1991 (JP) .
353853 12/1992 (JP) .
4-353858 12/1992 (JP) .
5 027469 2/1993 (JP) .
5-323639 * 12/1993 (JP) ..... 430/58.25
6-11859 * 1/1994 (JP) ..... 430/58.25
6-11863 * 1/1994 (JP) ..... 430/58.25

OTHER PUBLICATIONS

Gattrell, M. A Fourier Transform Infrared Spectroscopy Study or the Passive Film Produced during Aqueous Acidic Phenol Electro–oxidation. J. Electrochem. Soc., vol. 139, No. 10, pp. 2736–2744, Oct. 1992.*

* cited by examiner

*Primary Examiner*—Christopher Rodee
(74) *Attorney, Agent, or Firm*—Fitzpatrick, Cella, Harper & Scinto

(57) ABSTRACT

A polymer has a structural unit represented by the following formula (1):

(1)

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ may be the same or different. An electrophotographic photosensitive member is formed of the polymer. A process cartridge and an electrophotographic apparatus include the electrophotographic photosensitive member.

21 Claims, 3 Drawing Sheets

POLYMER, ELECTROPHOTOGRAPHIC PHOTOSENSITIVE MEMBER CONTAINING THE POLYMER, PROCESS CARTRIDGE AND ELECTROPHOTOGRAPHIC APPARATUS HAVING THE ELECTROPHOTOGRAPHIC PHOTOSENSITIVE MEMBER

BACKGROUND OF THE INVENTION

1. Field of the Invention

The present invention relates to a polymer having a novel structure, and in particular, relates to a polymer having electron transportability. The present invention also relates to an electrophotographic photosensitive member containing this polymer, and a process cartridge and an electrophotographic apparatus having the electrophotographic photosensitive member.

2. Description of the Related Art

Electronic devices such as electrophotographic photosensitive members and solar batteries require materials for effectively transporting only electrons or holes. Hole-transporting materials which transport only holes at a high efficiency have been widely used for electrophotographic photosensitive members. Charge-transporting materials also have been used for ozone-free electrophotographic photosensitive members. Examples of known charge-transporting materials include organic materials, such as a diphenoquinone derivative (as disclosed in Japanese Patent Laid-Open No. 3-216662), an imide derivative (as disclosed in Japanese Patent Laid-Open No. 5-27469), and a TNF derivative (as disclosed in Japanese Patent Laid-Open No. 2-203352); and low.molecular weight compounds, e.g. a charge-transporting complex comprising an acceptor compound and a donor compound (as disclosed in Japanese Patent Laid-Open No. 1-314253). Further, polymeric compounds having electron transportability are disclosed in Japanese Patent Laid-Open Nos. 2-123370 and 4-353858.

Charge-transporting materials, however, have not been disclosed as much as hole-transporting materials. The low molecular weight compound must be dissolved into an appropriate resin in the film forming process. However, the solubility or compatibility of the charge-transporting material in the resin matrix is limited. When a high content of the charge-transporting material is added, the crystals of the charge-transporting material are precipitated. On the other hand, a low content of the charge-transporting material does not have sufficient electron transportability. Since the low molecular weight compound does not have satisfactory mechanical strength, scuffs and cracks form in use. Most of the polymeric compounds are a side chain type in which side chains have electron transportability. In side chain type polymeric compounds, cohesiveness between molecular chains is low, and this inhibits improvement in the electron transportability.

SUMMARY OF THE INVENTION

It is an object of the present invention to provide a novel polymer having electron transportability.

It is another object of the present invention to provide a polymer having electron transportability allowing the formation of a significantly uniform film.

It is still another object of the present invention to provide an electrophotographic photosensitive member containing the polymer.

It is a further object of the present invention to provide an electrophotographic photosensitive member having high sensitivity and high durability.

It is a still further object of the present invention to provide a process cartridge and an electrophotographic apparatus having the electrophotographic photosensitive member.

A first aspect of the present invention is a polymer having a structural unit represented by the following formula (1):

(1)

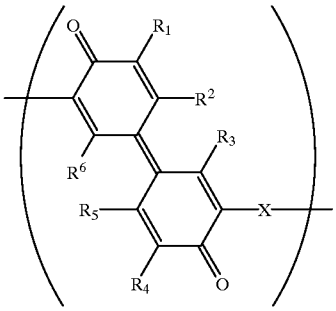

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ may be the same or different.

A second aspect of the present invention is an electrophotographic photosensitive member comprising a substrate and a photosensitive layer formed thereon;

the photosensitive layer containing a polymer having a structural unit represented by the following formula (1):

(1)

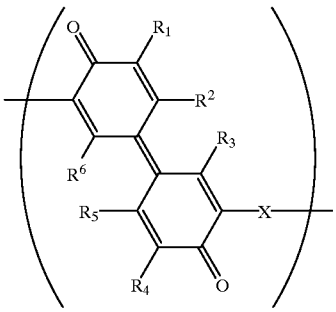

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ may be the same or different.

A third aspect of the present invention is an electrophotographic photosensitive member comprising a substrate, an intermediate layer on the substrate, and a photosensitive layer on the intermediate layer;

the intermediate layer containing a polymer having a structural unit represented by the following formula (1):

(1)

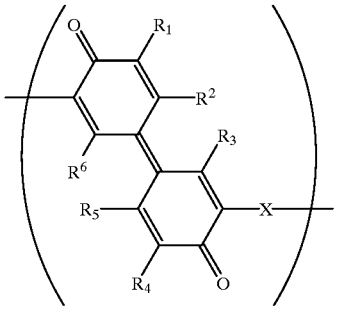

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ may be the same or different.

Further aspects of the present invention are a process cartridge and an electrophotographic apparatus having the electrophotographic photosensitive member.

Further objects, features and advantages of the present invention will become apparent from the following description of the preferred embodiments with reference to the attached drawings.

DESCRIPTION OF THE PREFERRED EMBODIMENT

Figure 1:
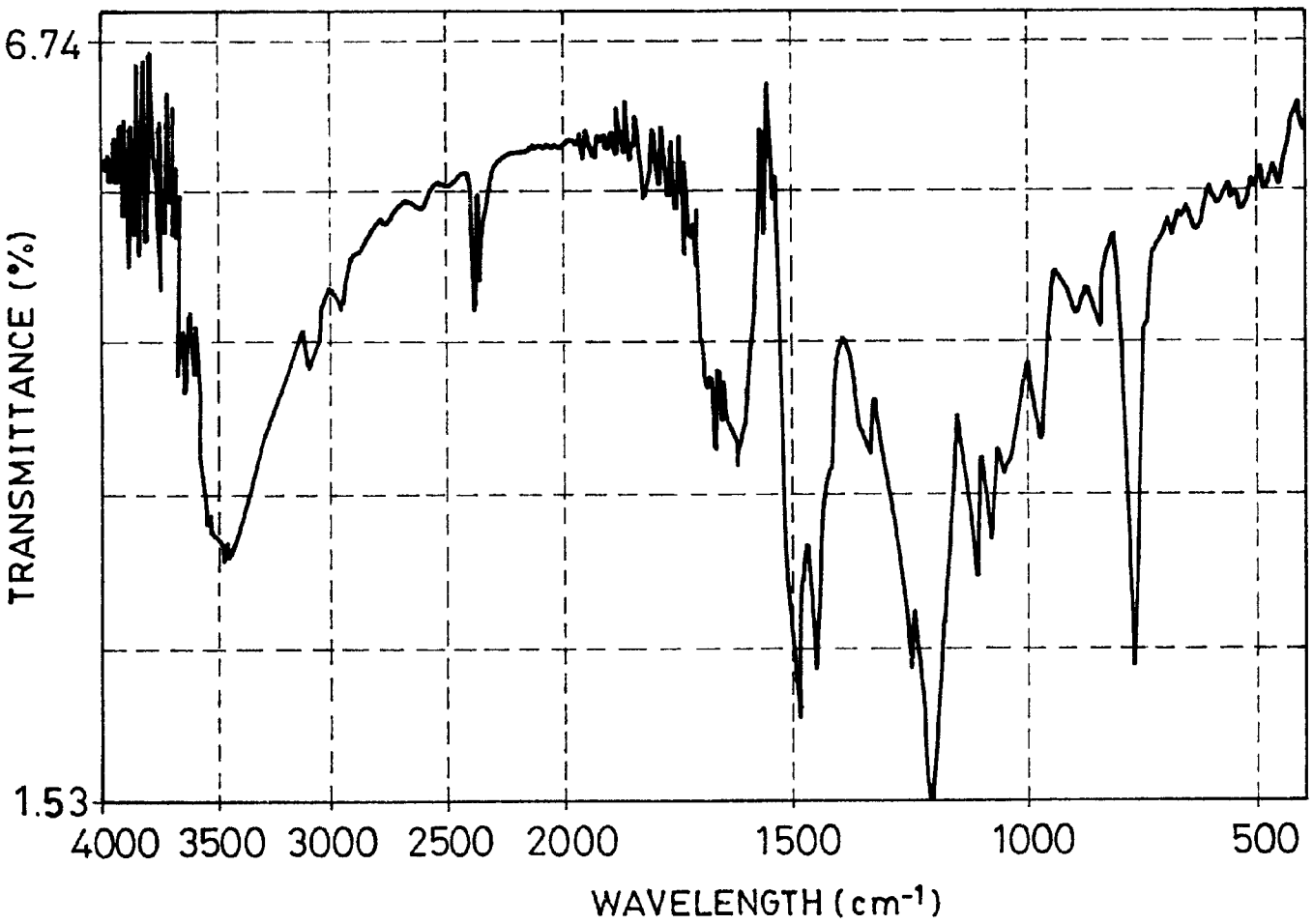
FIG. 1 is an IR spectrum of a polymer in accordance with the present invention.

The polymer in accordance with the present invention has a structural unit represented by the following formula (1):

(1)

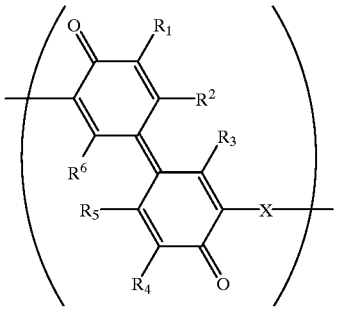

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ may be the same or different.

In the formula (1), the alkylene group preferably has 1 to 4 carbon atoms, and the alkyl group preferably has 1 to 8 carbon atoms. Examples of preferable alkylene groups include methylene, ethylene, and propylene. Examples of preferable alkyl groups include methyl, ethyl, propyl, isopropyl, butyl, tert-butyl, hexyl, and octyl. The alkoxy group preferably has 1 to 8 carbon atoms. Examples of preferable alkoxy groups include methoxy, ethoxy, propoxy, isopropoxy, butoxy, isobutoxy, hexoxy, and octoxy.

Examples of substituents of the above-mentioned substituted alkylene, alkyl or alkoxy groups include halogen atoms, e.g. fluorine, chlorine, and bromine; alkyl groups, e.g. methyl, ethyl, and propyl; and alkoxy groups, e.g. methoxy, ethoxy, and propoxy.

The single bond of X is represented by, for example, Structural Unit (1) which will be described later.

In a preferable embodiment of the present invention, X is single bond, a methylene group or —O—, $R_1$ and $R_4$ are each a hydrogen atom, or an alkyl or alkoxy group, and $R_2$, $R_3$, $R_5$ and $R_6$ are each a hydrogen atom, in view of film formability.

In the polymer in accordance with the present invention, electron transport is carried by the main chain, not the side chain. Thus, the polymer chains have high cohesive force. Since the polymer has electron transportability, it is significantly high and uniform. In the present invention, the polymer has excellent electron transportability by combination of these factors.

A polymer in accordance with the present invention may be synthesized by refluxing with heat a corresponding bisphenol with a halogenated solvent, such as chloroform, dichloromethane, or dichloroethane, for 12 to 48 hours, in the presence of a Fetizon reagent as an oxidizing agent with silver (I) oxide (M. Fetizon, M. Golfier, P. Mourgues, and J.-M. Louis, "Organic Synthesis by Oxidation with Metal Compounds", ed. by W. J. Mijs and C. R. H. I. de Jonge, Plenum Press (1986) pp. 503–567). Fetizon reagent is silver carbonate ($Ag_2CO_3$) on Celite® filter agent.

Examples of oxidizing agents used in the present invention, other than the Fetizon reagent, include chromic acid, permanganic acid, and mercury compounds which can oxidize phenol to form diphenoquinone. The Fetizon reagent is preferably used in view of the subsequent treatment.

It is preferable that the number average molecular weight of the polymer in accordance with the present invention be in a range of 500 to 20,000.

The following Structural Units (1) to (16) are nonlimiting preferable examples of the structural unit of the polymer in accordance with the present invention.

(1)

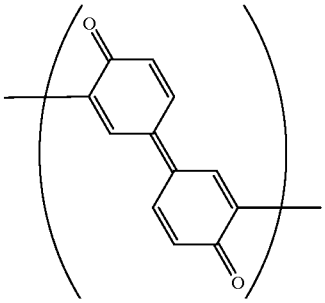

-continued
(2)
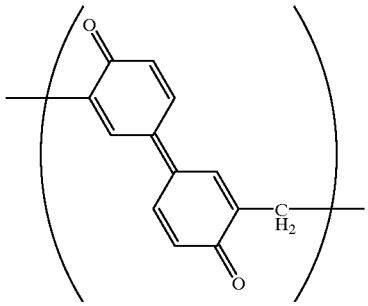
(3)
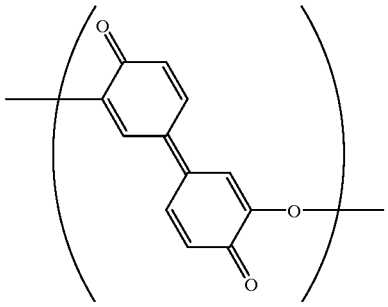
(4)
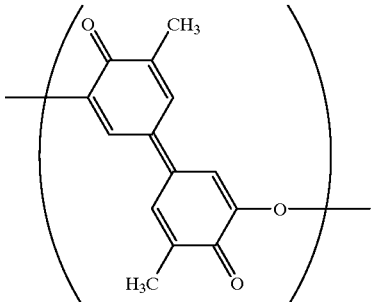
(5)
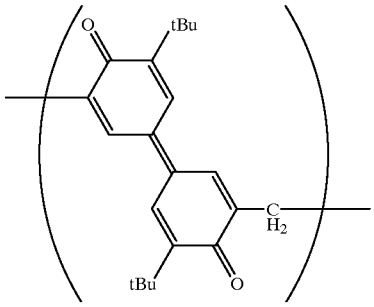
(6)
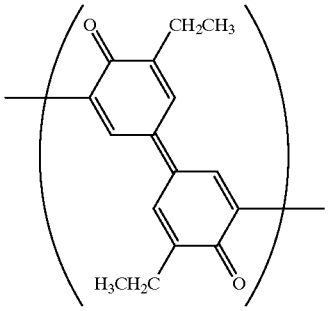
-continued
(7)
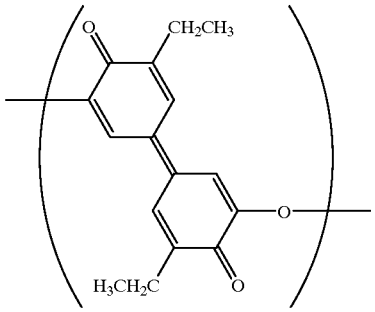
(8)
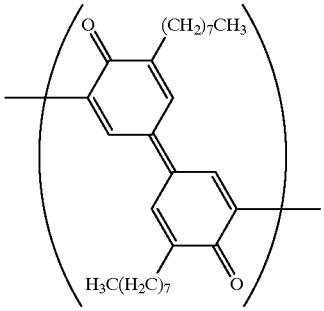
(9)
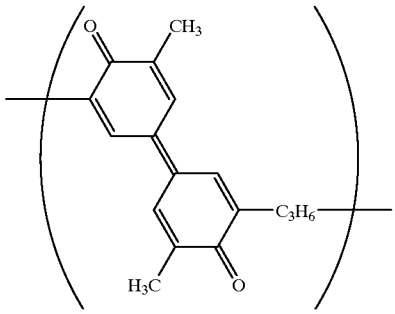
(10)
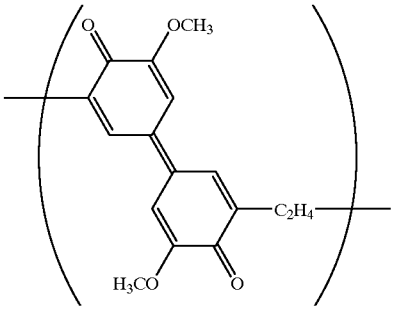
(11)
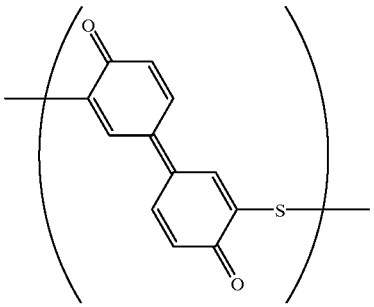

-continued (12)

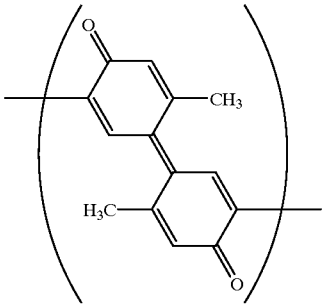

(13)

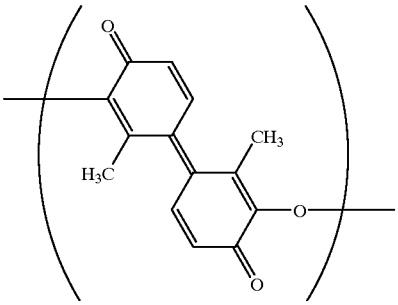

(14)

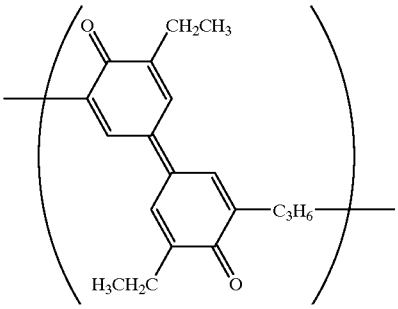

(15)

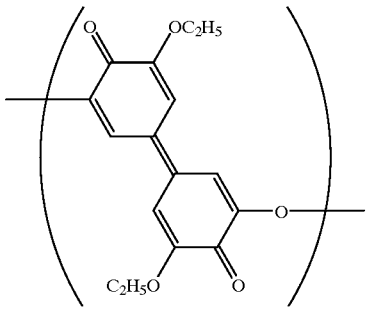

(16)

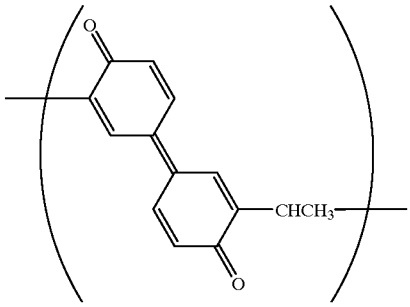

Among these, Structural Units (1), (2), (3), and (4) are more preferable.

Since the polymer in accordance with the present invention has high electron transportability as described above, it can be preferably used as a photosensitive layer of the electrophotographic photosensitive member or an intermediate layer between a substrate and the photosensitive layer. Thus, the electrophotographic photosensitive member in accordance with the present invention comprises a substrate and a photosensitive layer formed on the substrate, and may further comprise an intermediate layer between the substrate and the photosensitive layer.

The photosensitive layer may be of a single-layer type or a composite type. In the single-layer type, a charge-generating material and a charge-transporting material are contained in the same layer. The composite type photosensitive layer has a charge-generating layer containing a charge-generating material and a charge-transporting layer containing a charge-transporting material. In the present invention, a composite type photosensitive layer is preferably used in view of electrophotographic characteristics.

When the polymer in accordance with the present invention is used in a photosensitive layer, the polymer functions as a charge-transporting material.

When a charge-transporting layer is formed using the polymer in accordance with the present invention, a solution of the polymer dissolved in an adequate solvent is applied onto a substrate and dried. It is preferable that the polymer be used together with a polycarbonate or polyarylate resin having high mechanical strength. When the polymer in accordance with the present invention is not used, the charge-transporting layer is formed by applying and drying a solution of a charge-transporting material and a binding resin dissolved in an adequate solvent to the substrate. Examples of usable charge-transporting materials include triarylamine derivatives, hydrazone derivatives, stilbene derivatives, pyrazoline derivatives, oxazole derivatives, triallylmethane derivatives, and thiazole derivatives. The ratio by weight of the charge-transporting material and the binding resin is preferably in a range of 1:0.5 to 1:2. The thickness of the charge-transporting layer is in a range of, preferably 5 to 40 $\mu$m, and more preferably 15 to 30 $\mu$m.

The charge-generating layer is formed as follows. A charge-generating material and a binding resin in a weight of 0.3 to 4 times to the charge-generating material are dispersed into a solvent using a homogenizer, an ultrasonic agitator, a ball mill, a vibration mill, a sand mill, an attritor, a roll mill, or a liquid collision-type high-speed dispersion mixer. The solution is applied onto a substrate and dried. Examples of charge-generating materials used in the present invention include selenium-tellurium, pyrylium, and thiapyrylium dyes; and phthalocyanine, anthanthrone, dibenzopyrenequinone, trisazo, cyanine, disazo, monoazo, indigo, quinacridone, and asymmetric quinocyanine pigments. The thickness of the charge-generating layer is in a range of, preferably 5 $\mu$m or less, and more preferably 0.1 to 2 $\mu$m.

When the photosensitive layer is of a mono layer type, it is formed as follows. A charge-generating material, a charge-transporting material, and a binding resin are dissolved into a solvent, and the solution is applied onto a substrate and then dried. The thickness of the photosensitive layer is in a range of, preferably, 5 to 40 $\mu$m. and more preferably 15 to 30 $\mu$m.

Any conductive materials may be used for a substrate in the present invention. Examples of materials include metals and alloys, e.g. aluminum and stainless steel; and conductive composites of metal, paper or plastic having conductive layers. The shape of the substrate is, for example, sheet-like or cylindrical.

In the present invention, a conductive layer may be provided between the substrate and the photosensitive layer for the purpose of preventing generation of interference bands and of covering minor defects on the substrate. The conductive layer may be formed as follows. A conductive powder, such as carbon black, metal powder, or metal oxide powder, is dispersed into a solvent, and the dispersion is applied onto the substrate and then dried. The thickness of the conductive layer is in a range of, preferably 5 to 40 $\mu$m. and more preferably 10 to 30 $\mu$m.

In the present invention, an intermediate layer may be provided between the substrate or conductive layer and the photosensitive layer, if necessary. The intermediate layer functions as a binder and a barrier. The intermediate layer is formed as follows. A resinous material is dissolved into a solvent, and the solution is applied onto the substrate or conductive layer and then dried. Examples of materials used for the intermediate layer include the polymer in accordance with the present invention, polyamides, polyvinylalcohol, polyethylene oxide, ethyl cellulose, casein, polyurethanes, and polyetherpolyurethanes. When the polarity of primary charge is negative, positive holes are injected from the substrate into the photosensitive layer. The polymer in accordance with the present invention does not transport the positive holes, but transports electrons from the photosensitive layer. Thus, the polymer in accordance with the present invention is preferable as the intermediate layer material. The thickness of the intermediate layer is in a range of, preferably 0.05 to 5 $\mu$m, and more preferably 0.3 to 1 $\mu$m.

Figure 3:
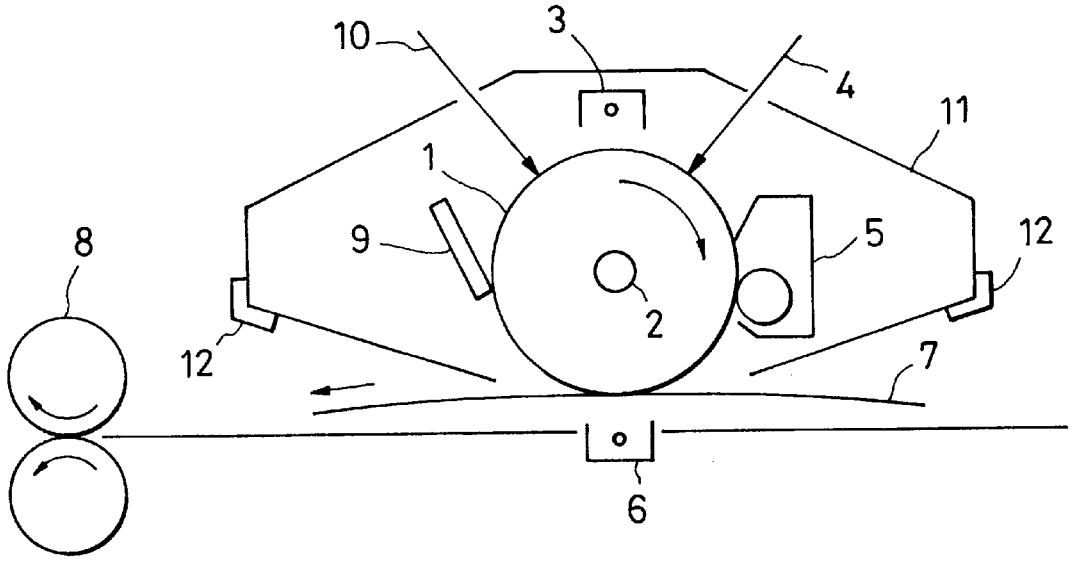
FIG. 3 is a schematic cross-sectional view of an electrophotographic apparatus provided with a process cartridge having an electrophotographic photosensitive member in accordance with the present invention.

FIG. 3 is a schematic cross-sectional view of an electrophotographic apparatus provided with a process cartridge having an electrophotographic photosensitive member in accordance with the present invention. A cylindrical electrophotographic photosensitive member 1 rotates around an axis 2 at a given speed in the direction of the arrow. The rotating electrophotographic photosensitive member 1 is uniformly charged into a given positive or negative potential by a primary charging means 3, and exposed by exposing light beams 4 from an exposing means (not shown in the drawing), such as a slit exposing unit or a laser beam scanning unit. An electrostatic latent image is thereby formed onto the photosensitive member 1.

The latent image is developed with toner from a developing means 5, and the resulting toner image is transferred onto a transfer medium 7, which is fed between the photosensitive member 1 and a transfer means 6 from a feeder (not shown in the drawing) synchronous with the rotation of the photosensitive member 1. The transfer medium 7 having the transferred image is separated from the surface of the photosensitive member 1, introduced into a fixer 8 to fix the transferred image, and discharged as a copy from the apparatus.

The surface of the photosensitive member 1 is cleaned by a cleaning means 9 removing the residual toner on the surface, blanket discharged by preliminary exposing light beams 10 from a preliminary exposing unit (not shown in the drawing), and subjected to the formation of the next image. When the primary charging means 3 is a contact charging type using, for example, a charging roller, preliminary exposure is not always necessary.

In the present invention, some of the above-mentioned components including the electrophotographic photosensitive member 1, the primary charging means 3, the developing means 5 and the cleaning means 9 may be integrated as a process cartridge, and the process cartridge may be detachably mounted in an electrophotographic apparatus such as a copying machine or a laser beam printer. For example, at least one component of the primary charging means 3, the developing means 5 and the cleaning means 9 are held together with the photosensitive member 1 in a process cartridge 11 which is attached to and detached from the apparatus by a guide such as rails 12 of the apparatus.

When the electrophotographic apparatus is a copying machine or a printer, the exposing light beams 4 are scanning laser beams based on signals read from a document through a sensor or radiating laser beams through an LED array driver or a liquid crystal array driver which drives in response to the signals.

The electrophotographic photosensitive member in accordance with the present invention can be used in, not only electrophotographic copying machines, but also in laser beam printers, CRT printers, LED printers, liquid crystal printers, and laser electrophotographic fields.

The present invention will now be described in detail with reference to Examples.

EXAMPLE 1

To a solution of 4.65 g of 2,2'-dihydroxybiphenyl in 1,000 ml of chloroform, 50 g of a Fetizon reagent was added. The mixture was refluxed while being heated for 40 hours. The mixture was cooled to room temperature, and then filtered. The solid component was dispersed for washing into 500 ml of methanol. The methanol washing was repeated three times. A brown polymer having Structural Unit (1) was obtained. The yield was 0.85 g, the weight average molecular weight Mw by gel permeation chromatography was 5,300, and the number average molecular weight Mn was 3,700. The IR spectrum of the resulting polymer is shown in FIG. 1. The absorption band near 1,600 $cm^{-1}$ based on the C═O bond indicates that the polymer has an objective structure.

EXAMPLE 2

Figure 2:
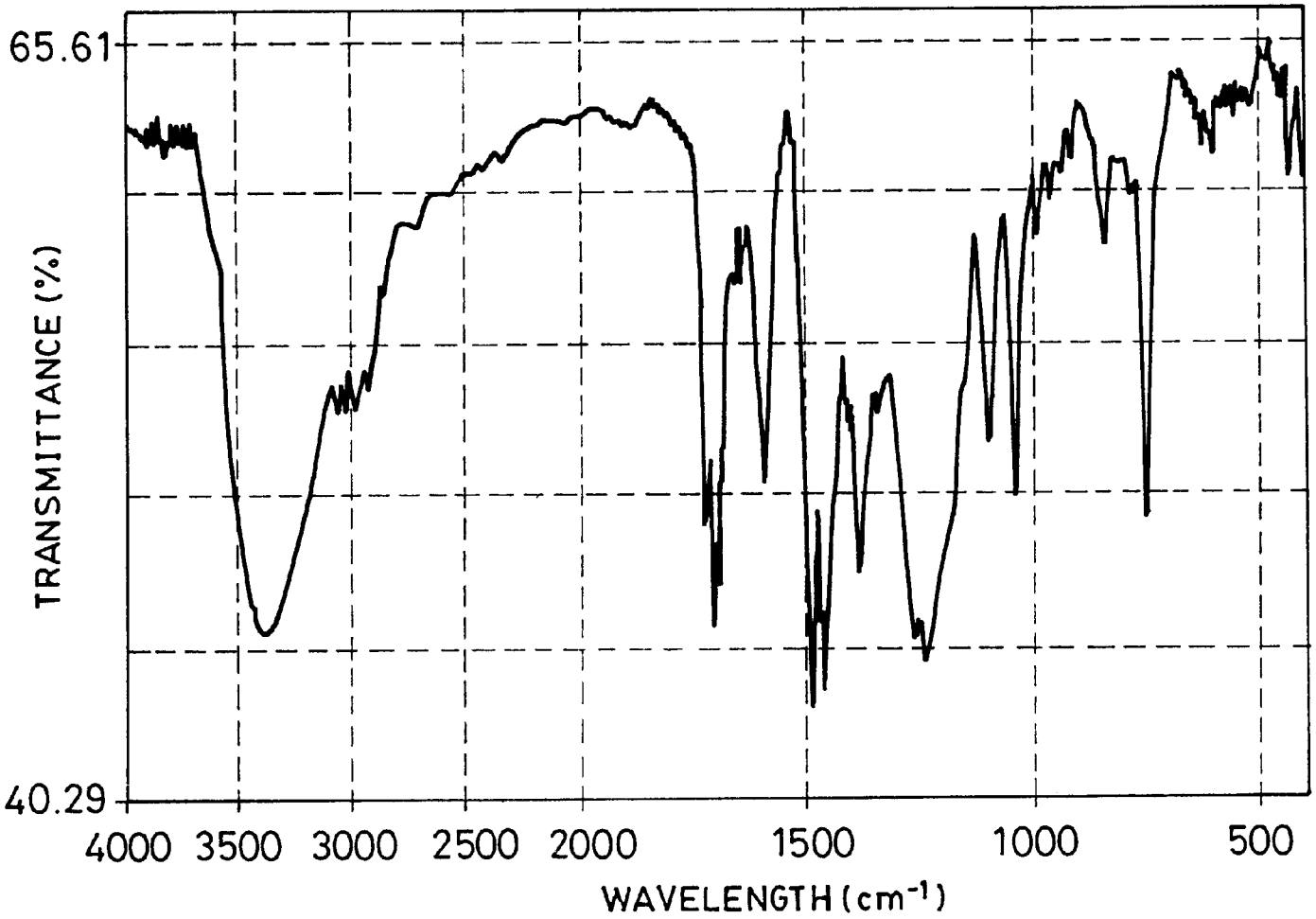
FIG. 2 is an IR spectrum of another polymer in accordance with the present invention.

To a solution of 5 g of di-(2-hydroxyphenyl)methane in 1,000 ml of chloroform, 50 g of a Fetizon reagent was added. The mixture was refluxed while being heated for 24 hours. The mixture was cooled to room temperature, and then filtered. The solid component was dispersed for washing into 500 ml of methanol. The methanol washing was repeated three times. A brown viscous polymer having Structural Unit (2) was obtained. The yield was 1.5 g, the Mw was 8,400, and the Mn was 6,300. The IR spectrum of the resulting polymer is shown in FIG. 2. The absorption band near 1,600 $cm^{-1}$ based on the C═O bond indicates that the polymer has an objective structure.

EXAMPLE 3

The polymer prepared in EXAMPLE 1 (1.0 g) was dissolved into 10 g of chloroform. The solution was applied onto an aluminum substrate by a wire bar, and then dried. A film with a thickness of 3 $\mu$m was formed on the substrate. According to visual inspection, the film had a smooth surface without crystal precipitation.

EXAMPLE 4

An alcohol-soluble copolymeric nylon resin (45 parts by weight) made by Toray Industries, Inc., (commercial name: AMILAN CM-8000) was dissolved into a mixed solvent of methanol (200 parts by weight), ethanol (60 parts by weight) and butanol (40 parts by weight). The solution was applied onto an aluminum sheet by a wire bar, and then dried at 150° C. for 10 minutes. An underlayer with a thickness of 0.5 $\mu$m was thereby formed.

An x-type metal free phthalocyanine (2 parts by weight), a polyvinyl butyral resin (1 part by weight) made by Sekisui Chemical Co., Ltd. (commercial name: S-LEC BM-2), and cyclohexanone (120 parts by weight) were dispersed in a ball mill. The dispersion was applied onto the underlayer by a wire bar, and then dried at 100° C. for 1 hour. A charge-generating layer with a thickness of 0.5 μm was thereby formed.

A solution of 2.5 parts by weight of the polymer prepared in EXAMPLE 1, 10 parts by weight of a polycarbonate resin made by Teijin Ltd., (commercial name: C-1400), and 80 parts by weight of monochlorobenzene was applied onto the charge-generating layer by a wire bar, and dried at 110° C. for 1 hour. An electrophotographic photosensitive member having a charge-transporting layer with a thickness of 20 μm was thereby formed.

The electrophotographic photosensitive member was evaluated using an electrostatic copying tester EPA-8100 made by Kawaguchi Denki K.K. as follows. The electrophotographic photosensitive member was charged by a corona charger at a temperature of 23° C. and a humidity of 50% RH so that the surface potential was +700 volts. The surface was exposed with 780-nm monochromic light through a monochromator. The amount of light, which is necessary to attenuate the surface potential to +350 volts, as an initial sensitivity ($E_{1/2}$), was measured. A charging-exposing-discharging cycle under the same conditions having a cycle time of 3 seconds was repeated 5,000 times, and a sensitivity ($E_{1/2,5000}$) was measured. The results are shown in Table 1.

COMPARATIVE EXAMPLE 1

An electrophotographic photosensitive member was formed as in EXAMPLE 4 using a diphenoquinone compound in place of the polymer prepared in EXAMPLE 1, and evaluated as in Example 4. The results are shown in Table 1.

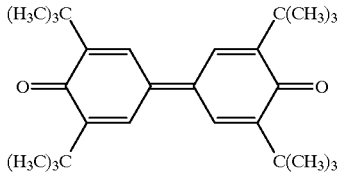

EXAMPLE 5 TO 8

Electrophotographic photosensitive members were formed using 8 parts by weight of polymers having different structural units as shown in Table 1 and 10 parts by weight of a polycarbonate resin, and evaluated as in Example 4. The results are shown in Table 1. All of the electrophotographic photosensitive members had smooth surfaces, according to visual inspection.

COMPARATIVE EXAMPLE 2

An electrophotographic photosensitive member was formed as in EXAMPLE 5 using a diphenoquinone compound used in COMPARATIVE EXAMPLE 1. Since crystal precipitation was visually observed on the surface, no sensitivity was evaluated.

EXAMPLE 9

A solution of 10 parts by weight of the polymer prepared in EXAMPLE 1, 170 parts by weight of chloroform, and 170 parts by weight of chlorobenzene was applied onto an aluminum sheet by a wire bar, and dried at 100° C. for 15 minutes to form an intermediate layer.

Next, 2 parts by weight of oxytitanium phthalocyanine, 1 part by weight of a polyvinyl butyral resin made by Sekisui Chemical Co., Ltd. (commercial name: S-LEC BM-2), and 120 parts by weight of dichloromethane were dispersed in a ball mill. The dispersion was applied onto the intermediate layer by a wire bar, and dried at 100° C. for 1 hour. A charge-generating layer with a thickness of 0.5 μm was thereby formed.

Next, 5 parts by weight of a charge-transporting material represented by the following formula and 5 parts by weight of a polycarbonate resin C-1400 made by Teijin Ltd. were dissolved into 40 parts by weight of monochlorobenzene. The solution was applied onto the charge-generating layer by a wire bar, and then dried. A charge-transporting layer with a thickness of 20 μm was thereby formed.

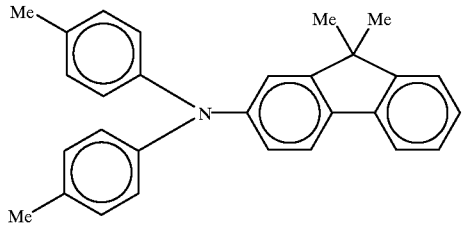

The photosensitive member was evaluated as in EXAMPLE 4 at a charging potential of −700 volts and a surface potential after exposure of −350 volts. The results are shown in Table 1.

EXAMPLE 10 TO 12

Photosensitive members were formed and evaluated as in EXAMPLE 9 using polymers having different structural units as shown in Table 1. The results are also shown in Table 1.

COMPARATIVE EXAMPLE 3

Into a mixed solvent of 170 parts by weight of chloroform and 20 parts by weight of chlorobenzene, 2 parts by weight of the diphenoquinone compound used in COMPARATIVE EXAMPLE 1 and 8 parts by weight of a polycarbonate resin, IUPILON-Z200, made by Mitsubishi Engineering-Plastics Corporation was dissolved. The solution was applied onto an aluminum sheet by a wire bar, and then dried at 100° C. for 15 minutes. An intermediate layer with a thickness of 1.5 μm was thereby formed. Next, an electrophotographic photosensitive member was formed and evaluated as in EXAMPLE 9. The results are shown in Table 1.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

TABLE 1

| | Structural Unit | $E_{1/2}$ ($\mu$ J/cm$^2$) | $E_{1/2.5000}$ ($\mu$ J/cm$^2$) |
|---|---|---|---|
| EXAMPLE 4 | (1) | 2.2 | 2.5 |
| EXAMPLE 5 | (1) | 1.8 | 2.0 |
| EXAMPLE 6 | (2) | 1.7 | 1.9 |
| EXAMPLE 7 | (3) | 1.7 | 2.0 |
| EXAMPLE 8 | (4) | 1.8 | 2.1 |
| EXAMPLE 9 | (1) | 0.32 | 0.39 |
| EXAMPLE 10 | (2) | 0.38 | 0.42 |
| EXAMPLE 11 | (3) | 0.33 | 0.40 |
| EXAMPLE 12 | (4) | 0.30 | 0.38 |
| COMPARATIVE EXAMPLE 1 | — | 6.0 | 7.0 |
| COMPARATIVE EXAMPLE 2 | — | Not measured | Not measured |
| COMPARATIVE EXAMPLE 3 | — | 0.41 | 0.59 |

What is claimed is:

1. An electrophotographic photosensitive member comprising a substrate and a photosensitive layer formed thereon;

said photosensitive layer containing a polymer having a structural unit represented by the following formula (1):

(1)

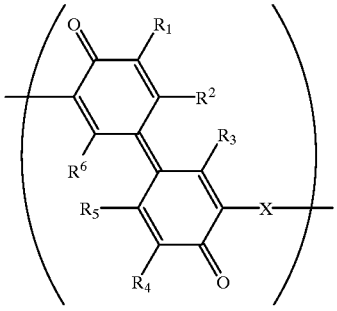

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ are the same or different.

2. An electrophotographic photosensitive member according to claim 1, wherein the polymer has electron transportability.

3. An electrophotographic photosensitive member according to either claim 1 or 2, wherein X is single bond or methylene group, $R_1$ and $R_4$ are each hydrogen atom, alkyl group or alkoxy group, and $R_2$, $R_3$, $R_5$ and $R_6$ are each hydrogen atom.

4. An electrophotographic photosensitive member according to either claim 1 or 2, wherein the photosensitive layer comprises a charge-generating layer and a charge-transporting layer, and the charge-transporting layer contains the polymer.

5. An electrophotographic photosensitive member comprising a substrate, an intermediate layer on said substrate, and a photosensitive layer on said intermediate layer;

said intermediate layer containing a polymer having a structural unit represented by the following formula (1):

(1)

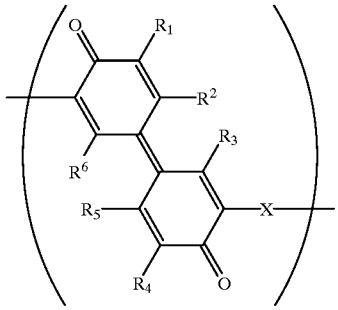

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ are the same or different.

6. An electrophotographic photosensitive member according to claim 5, wherein the polymer has electron transportability.

7. An electrophotographic photosensitive member according to either claim 5 or 6, wherein X is single bond or methylene group, $R_1$ and $R_4$ are each hydrogen atom, alkyl group or alkoxy group, and $R_2$, $R_3$, $R_5$ and $R_6$ are each hydrogen atom.

8. A process cartridge comprising an electrophotographic photosensitive member, and at least one means selected from the group consisting of a charging means, a developing means, and a cleaning means; said electrophotographic photosensitive member and said at least one means being integrally supported and detachably mounted in an electrophotographic apparatus;

said electrophotographic photosensitive member comprising a substrate and a photosensitive layer formed thereon;

said photosensitive layer containing a polymer having a structural unit represented by the following formula (1):

(1)

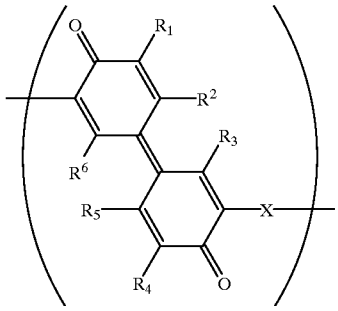

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ are the same or different.

9. A process cartridge according to claim 8, wherein the polymer has electron transportability.

10. A process cartridge according to either claim 8 or 9, wherein X is single bond or methylene group, $R_1$ and $R_4$ are each hydrogen atom, alkyl group or alkoxy group, and $R_2$, $R_3$, $R_5$ and $R_6$ are each hydrogen atom.

11. A process cartridge according to either claim 8 or 9, wherein the photosensitive layer comprises a charge-generating layer and a charge-transporting layer, and the charge-transporting layer contains the polymer.

12. A process cartridge comprising an electrophotographic photosensitive member, and at least one means selected from the group consisting of a charging means, a developing means, and a cleaning means; said electrophotographic photosensitive member and said at least one means being integrally supported and detachably mounted in an electrophotographic apparatus;

said electrophotographic photosensitive member comprising a substrate, an intermediate layer on said substrate, and a photosensitive layer on said intermediate layer;

said intermediate layer containing a polymer having a structural unit represented by the following formula (1):

(1)

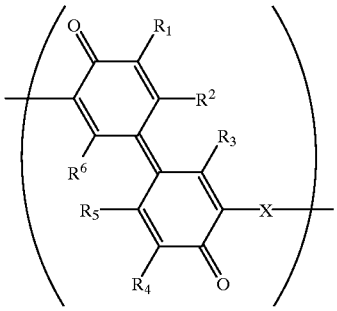

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ are the same or different.

13. A process cartridge according to claim 12, wherein the polymer has electron transportability.

14. A process cartridge according to either claim 12 or 13, wherein X is single bond or methylene group, $R_1$ and $R_4$ are each hydrogen atom, alkyl group or alkoxy group, and $R_2$, $R_3$, $R_5$ and $R_6$ are each hydrogen atom.

15. An electrophotographic apparatus comprising an electrophotographic photosensitive member, a charging means, an exposing means, a developing means, and a transfer means;

said electrophotographic photosensitive member comprising a substrate and a photosensitive layer formed thereon;

said photosensitive layer containing a polymer having a structural unit represented by the following formula (1):

(1)

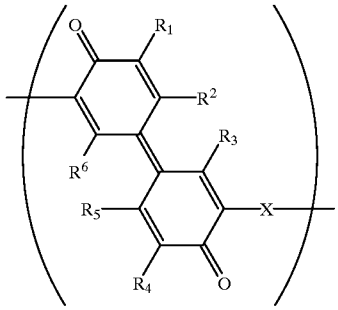

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ are the same or different.

16. An electrophotographic apparatus according to claim 15, wherein the polymer has electron transportability.

17. An electrophotographic apparatus according to either claim 15 or 16, wherein X is single bond or methylene group, $R_1$ and $R_4$ are each hydrogen atom, alkyl group or alkoxy group, and $R_2$, $R_3$, $R_5$ and $R_6$ are each hydrogen atom.

18. An electrophotographic apparatus according to either claim 15 or 16, wherein the photosensitive layer comprises a charge-generating layer and a charge-transporting layer, and the charge-transporting layer contains the polymer.

19. An electrophotographic apparatus comprising an electrophotographic photosensitive member, a charging means, an exposing means, a developing means, and a transfer means;

said electrophotographic photosensitive member comprising a substrate, an intermediate layer on said substrate, and a photosensitive layer on said intermediate layer;

said intermediate layer containing a polymer having a structural unit represented by the following formula (1):

(1)

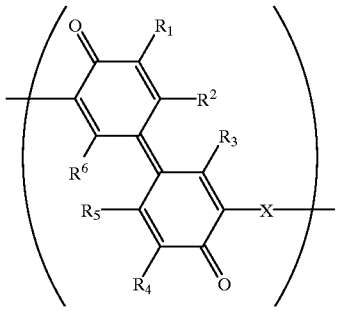

wherein X is single bond, substituted or unsubstituted alkylene group, —S—, or —O—, $R_1$ to $R_6$ are each hydrogen atom, substituted or unsubstituted alkyl group, or substituted or unsubstituted alkoxy group, and $R_1$ to $R_6$ are the same or different.

20. An electrophotographic apparatus according to claim 19, wherein the polymer has electron transportability.

21. An electrophotographic apparatus according to either claim 19 or 20, wherein X is single bond or methylene group, $R_1$ and $R_4$ are each hydrogen atom, alkyl group or alkoxy group, and $R_2$, $R_3$, $R_5$ and $R_6$ are each hydrogen atom.

* * * * *